US007572030B2

(12) United States Patent
Booth et al.

(10) Patent No.: US 7,572,030 B2
(45) Date of Patent: Aug. 11, 2009

(54) REFLECTOR BASED OPTICAL DESIGN

(75) Inventors: Ian Booth, Victoria (CA); Brock Johnston, Brentwood Bay (CA)

(73) Assignee: Carmanah Technologies Corp., Victoria, British Columbia (CA)

( * ) Notice: Subject to any disclaimer, the term of this patent is extended or adjusted under 35 U.S.C. 154(b) by 248 days.

(21) Appl. No.: 11/471,977

(22) Filed: Jun. 21, 2006

(65) Prior Publication Data

US 2006/0291209 A1 Dec. 28, 2006

Related U.S. Application Data

(60) Provisional application No. 60/595,316, filed on Jun. 22, 2005.

(51) Int. Cl.
*F21V 5/00* (2006.01)

(52) U.S. Cl. ..... 362/245; 362/236; 340/471

(58) Field of Classification Search ..... 362/153, 362/153.1, 235, 236, 245, 297, 302, 317, 362/346, 347, 517, 518, 545, 470, 477, 478, 362/479, 493, 514, 800; 340/471, 473, 908, 340/908.1, 981, 984

See application file for complete search history.

(56) References Cited

U.S. PATENT DOCUMENTS

| | | | | |
|---|---|---|---|---|
| 1,545,711 | A * | 7/1925 | Townsend | 362/305 |
| 5,224,773 | A | 7/1993 | Arimura | |
| 5,594,433 | A | 1/1997 | Terlep | |
| 5,608,290 | A | 3/1997 | Hutchisson et al. | |
| 5,642,933 | A * | 7/1997 | Hitora | 362/243 |
| 5,929,788 | A | 7/1999 | Vukosic | |
| 6,364,506 | B1 * | 4/2002 | Gallo | 362/245 |
| 6,464,373 | B1 * | 10/2002 | Petrick | 362/235 |
| 6,554,441 | B2 * | 4/2003 | Rohlfing et al. | 362/35 |
| 6,637,921 | B2 * | 10/2003 | Coushaine | 362/517 |
| 6,932,496 | B2 * | 8/2005 | Rizkin et al. | 362/299 |
| 6,997,595 | B2 | 2/2006 | Mi et al. | |
| 7,048,412 | B2 | 5/2006 | Martin et al. | |
| 7,344,266 | B2 * | 3/2008 | Coman | 362/153.1 |
| 2003/0193807 | A1 | 10/2003 | Rizkin et al. | |
| 2004/0057234 | A1 | 3/2004 | Mohacsi | |
| 2004/0095771 | A1 | 5/2004 | McDonald | |
| 2004/0095777 | A1 | 5/2004 | Trenchard et al. | |
| 2005/0146875 | A1 * | 7/2005 | Klein | 362/253 |

FOREIGN PATENT DOCUMENTS

| | | | |
|---|---|---|---|
| FR | 2334216 | A * | 8/1977 |
| GB | 2350176 | A | 11/2000 |
| GB | 2381065 | A | 4/2003 |
| JP | 2003258319 | | 9/2003 |

* cited by examiner

*Primary Examiner*—Hargobind S Sawhney
(74) *Attorney, Agent, or Firm*—Quarles & Brady LLP; Gavin J. Milczarek-Desai

(57) ABSTRACT

A novel optical design based on a faceted conical or curved reflector centered within an upward facing circular array of light emitting diodes (LED) and protected by a transparent cover.

5 Claims, 10 Drawing Sheets

REFLECTOR BASED OPTICAL DESIGN

RELATED APPLICATIONS

This application claims priority from U.S. Provisional Patent Application Ser. No. 60/595,316 filed Jun. 22, 2005 which is hereby incorporated by reference.

FIELD OF THE INVENTION

This invention relates to novel optical design based on a conical reflector (1) centered within an upward facing circular array of LEDs (8).

BACKGROUND OF THE INVENTION

Navigational light beacons typically emit a fan beam that is vertically narrow and broad in the horizontal plane. Lights of this type must have uniform output around the horizontal plane.

Since the advent of high brightness light emitting diodes (LED), a plethora of beacons have been designed to take advantage of the LED. The majority of these beacons utilize a plurality of narrow beam 5 mm LEDs in a circular array, where the axis of maximum intensity is directed outward and lies in the horizontal plane. The light output from the LEDs is typically collimated by an additional refractive optical element. A high intensity beacon requires a large number of these LEDs to produce the appropriate amount of light. The individual beam profiles of these LEDs are often seen as ripples in the horizontal uniformity. Adding a diffusion filter that spreads the light horizontally to smooth out the beam profile can eliminate these ripples, but may attenuate the light intensity. Recent innovations in LED technology have created dramatically brighter LEDs. These new LEDs facilitate the creation of high intensity beacons with substantially fewer LEDs. There are at least two difficulties in utilizing these new LEDs for beacons. The newer LEDs have wide (lambertian) beam patterns which makes collimating the LED's light difficult. In addition, the reduced number of LEDs can lead to non-uniform horizontal output. Manufacturing a beacon utilizing a plurality of Lambertian LEDs in a circular array, where the axis of maximum intensity is directed outward and lies in the horizontal plane is difficult.

SUMMARY OF THE INVENTION

The present invention provides light beacon reflector arrangement that emits a horizontal fan beam of light and a method for providing a desired intensity distribution for the beam of light.

The invention relies on the use of a plurality of wide angle (Lambertian) LEDs in a circular array, and a curved reflector in concentric relationship with the circular array. The reflector may extend from the plane in which the LEDs lie to a point outside the diameter of the circular array and the LEDs are arranged such that each LED's axis of maximum intensity is perpendicular to the plane in which the circular array lies.

The LEDs and the reflector may all be mounted on a planar circuit board. A beacon design utilizing a planar circuit board is desirable due to its suitability for automated production. This design eliminates the requirement for a diffusion filter to smooth out the ripples in many applications, as ripples are reduced to an acceptable level.

In one aspect of the invention, the reflector comprises a plurality of contiguous conical surface segments where each surface is designed to reflect a portion of the LEDs' light within a specific angular width, thereby facilitating the matching of the reflection characteristic to the desired intensity distribution by the selection of the location and reflection angle of each segment.

In another aspect of the invention the plurality of conical surfaces can be replaced by a smooth curved surface, where the curve is a spline that follows the plurality of segments.

In yet another aspect of the invention, there is provided a transparent cover that protects the reflector and the LEDs from moisture and other outdoor contaminants. Another aspect of the invention is a self-contained solar powered beacon utilizing this optical design.

Other aspects of the invention will be appreciated by reference to the description of the various embodiments of the invention that follow and from the claims.

BRIEF DESCRIPTION OF THE DRAWINGS

The embodiments of the invention will be described by reference to the drawings thereof in which.

DETAILED DESCRIPTION OF THE PREFERRED AND ALTERNATIVE EMBODIMENTS

Figure 1:
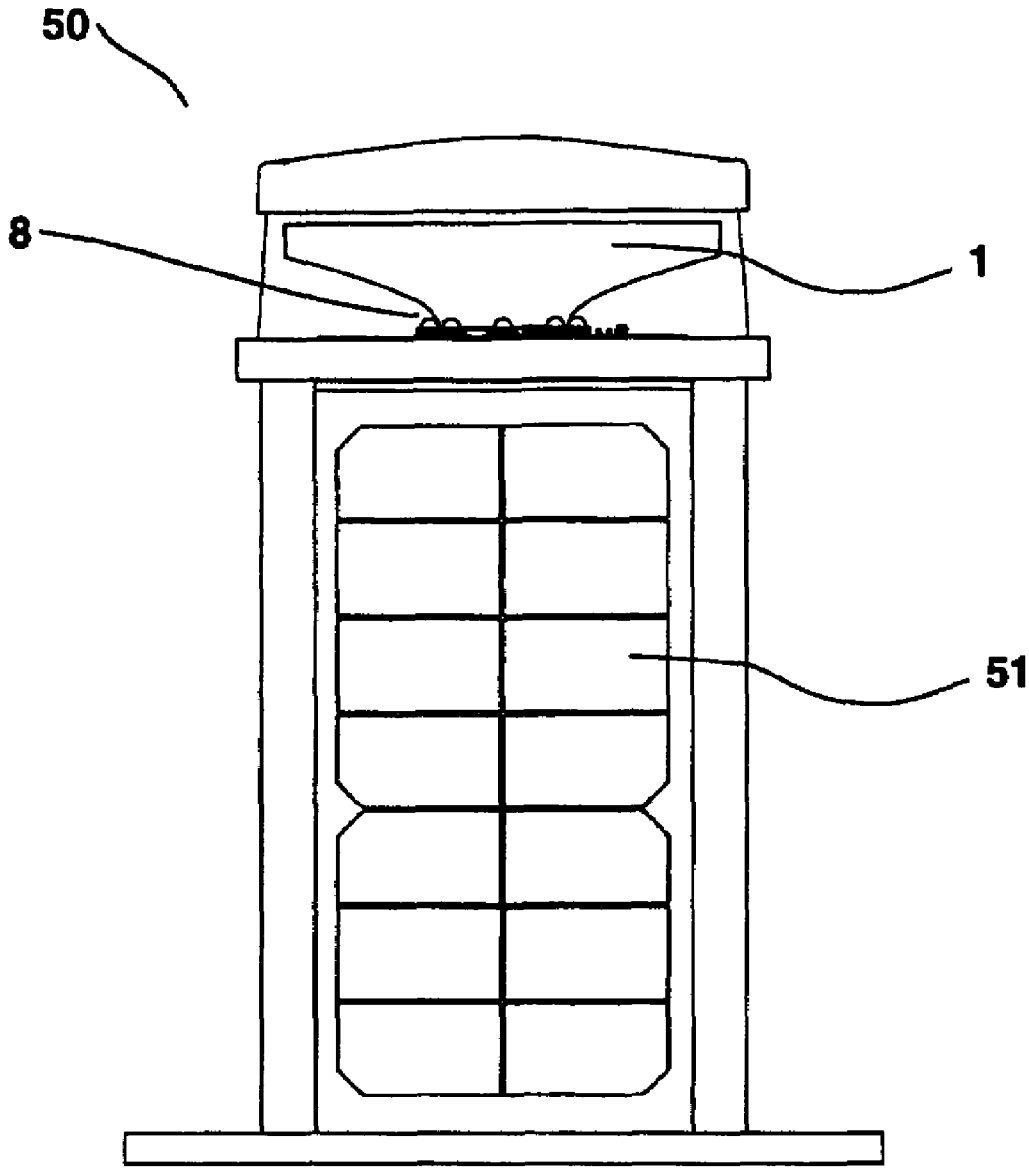
FIG. 1 is a side elevation of a beacon embodying the reflector assembly according to the invention.

FIG. 1 depicts a beacon 50 according to an embodiment of the invention including a reflector 1, wide-angle LEDs 8 and one or more solar panels 51. The beacon 50 may be utilized in applications that require a narrow beam of light such as marine or aviation navigation.

Figure 2A:
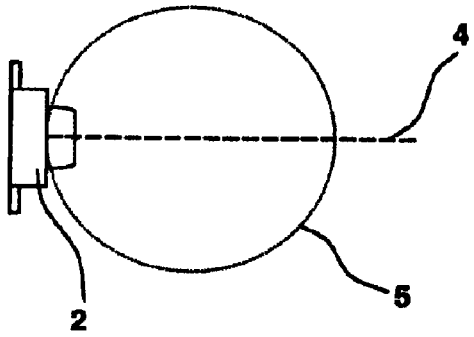
FIG. 2*a* is a schematic diagram illustrating the beam profile of an LED having a Lambertian beam pattern.
Figure 2B:
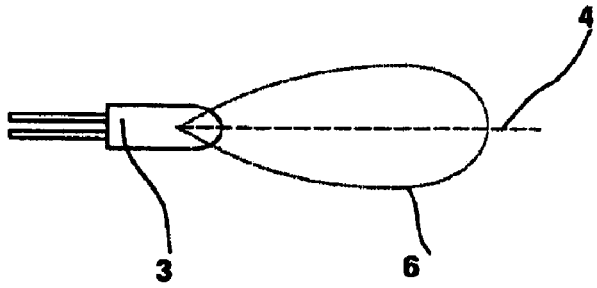
FIG. 2*b* is a schematic diagram illustrating the beam profile of a narrow beam LED.

FIG. 2*a* depicts a beam pattern 5 of the typical wide-angle LED 8 including the axis of maximum intensity 4. FIG. 2*b* depicts a narrow beam pattern 6 of the typical 5 mm LED 3.

Figure 3:
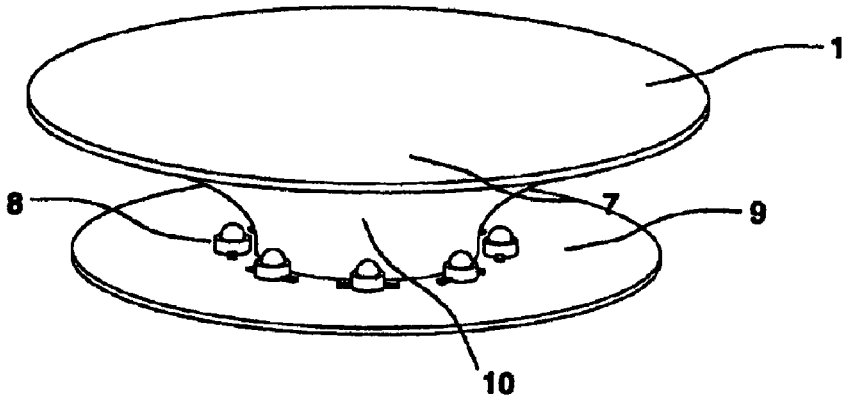
FIG. 3 is a perspective view of a reflector assembly according to an embodiment of the invention that uses a curved reflector.
Figure 4:
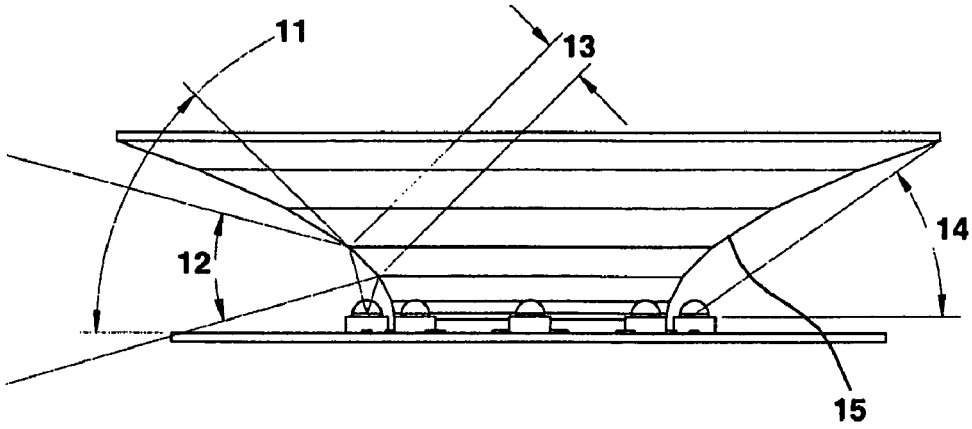
FIG. 4 is a side elevation of the reflector assembly of an embodiment that uses a faceted shape.
Figure 5:
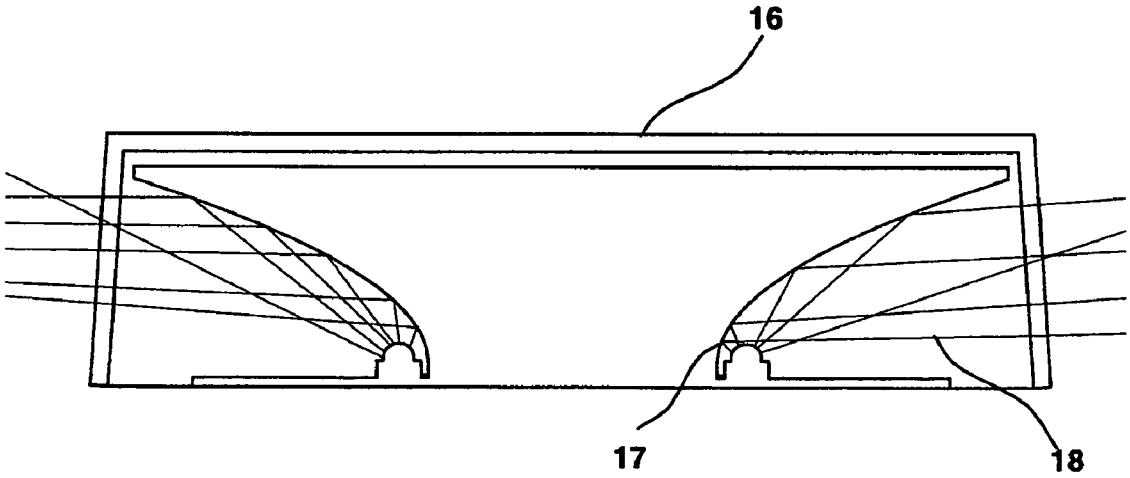
FIG. 5 is a side elevation section view of an embodiment that includes a transparent cover.

Referring to FIGS. 3, 4 and 5, there is shown a reflector arrangement according to the invention. A plurality of wide-angle (Lambertian) LEDs (8) are arranged in a circular array, pointing up at a curved or substantially conical reflector (1) concentric with the ring of LEDs 8. Both the LEDs and the reflector are mounted to a planar circuit board 9. The reflector is designed to reflect rays directed upward above some maximum angle 14 shown in FIG. 4, and rays inward 17 (see FIG. 5) toward the middle of the ring so that they go outward 18 from the ring within some specified angular width 12 above and/or below the horizontal plane.

The reflector comprises a surface revolved about the radial axis of the circular array of LEDs to form a truncated conic section. The reflector comprises a base, shown as the top portion in FIG. 3, and a vertex truncated where the reflector is secured to the circuit board 9. The diameter of the base of the reflector is larger than the diameter of the circular array of LEDs such that the top edge of the reflector overlaps the circular array. The diameter of the vertex is less than the diameter of the circular array.

The reflector 1 may be constructed from metal and the reflective surface 10 may be polished to a mirror finish, or the reflector may be made out of plastic and the reflective surface 10 may be coated with a reflective material such as aluminum or silver. The coating may then be coated again to prevent corrosion. A transparent cover 16 may protect the assembly from the outdoor environment.

Figure 6:
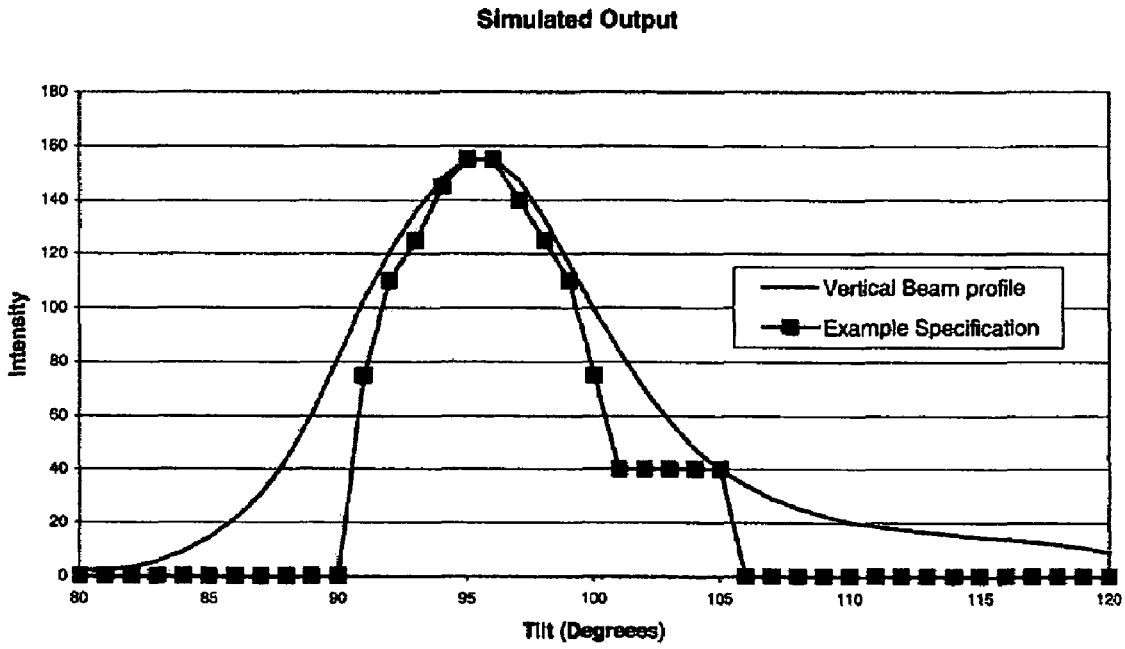
FIG. 6 is an example of a specified intensity distribution.

Typically the light emitted by the beacon must meet some specification (such as that presented in an aviation or marine standard) for intensity over some angular range about the horizontal plane. An example of such a specified intensity distribution (square dots) is shown in FIG. 6 together with a simulated output from the reflector (smooth trace). The design in FIG. 9 meets or exceeds the specification detailed in FIG. 6. In order to direct the light in such a way as to meet required intensity specifications the shape of the reflector surface 10 is selected so as to direct the reflected light rays into specific angular segments from various parts of the reflector surface 10 as illustrated in FIG. 4. Each linear segment can be designed to direct light rays into a specific angular beam width around the horizontal plane, with this beam width being proportional to the length of the segment 13. The angle of the segment relative to the horizontal plane 11 determines the overall direction of this beam. The additive sum of the individual beams from each segment constitutes the output beam of the beacon. This provides a means of customizing the reflector to meet various specifications by modifying the location, length and angle of each segment 15. The desired intensity distribution is ascertained. The intensity distribution is then segregated into discrete adjacent segments wherein a direction and beam width representative of each segment is determined. From such specifications, the length and angle of nominal flat reflective surfaces that are required to achieve the desired reflection direction and beam width are determined. This determination takes into account the relative positions of the LEDs. A reflector is then provided that consists of a plurality of flat adjacent segments corresponding to the nominal reflective surfaces. Each flat segment is revolved about the array axis to yield a segment of a right circular cone.

Figure 7:
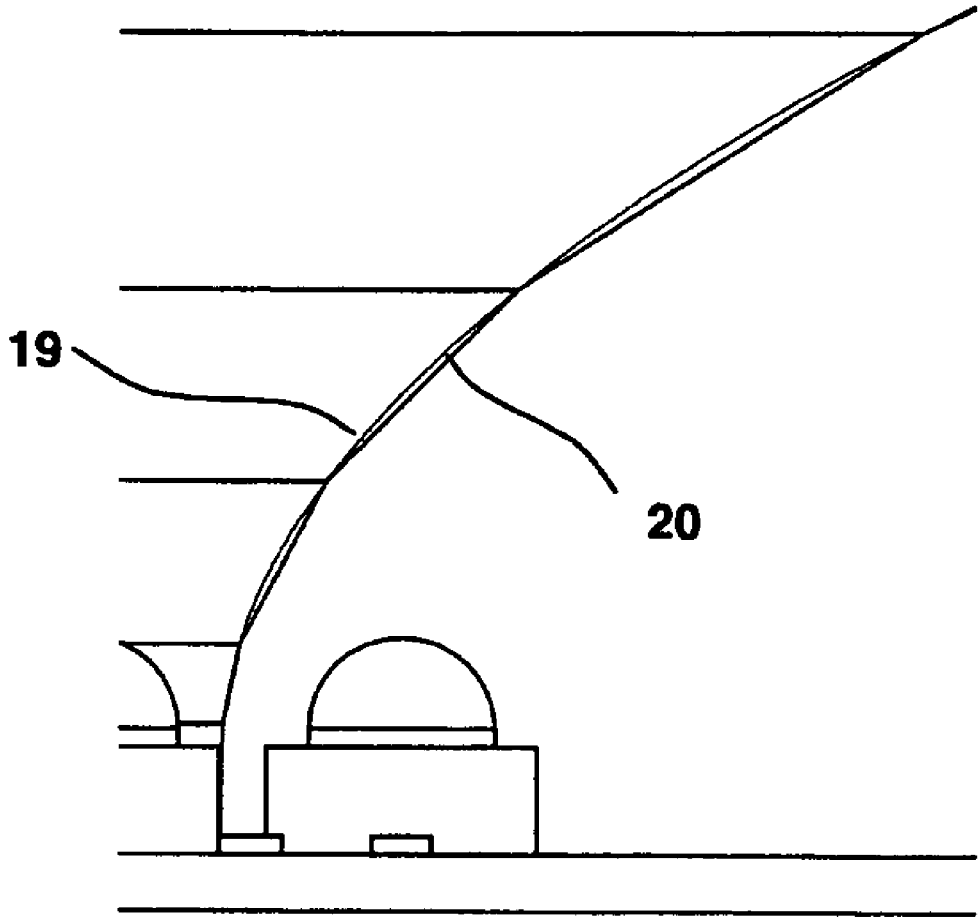
FIG. 7 is a partial side elevation of a reflector assembly according to an embodiment illustrating a spline fit used to produce an alternative embodiment of the invention.

In order to meet a specified intensity distribution as efficiently as possible it is desirable to be able to direct rays reflected by particular parts of the reflector surface 10 into a beam with the minimum possible width. The minimum angular beam width that can be produced by this design is limited by several factors. The finite size of the emitting area within the LED 8 introduces an inherent angular size as any reflecting point on the reflector surface 10 receives light rays from a distributed source and thus the reflected rays have a corresponding angular width. Making the reflector surface 10 larger in size relative to the LEDs 8 can reduce this limitation. Once a plurality of segments have been defined to provide the desired beam profile, a spline 19 may be fit to the series of segments 20 and to create a curved rather than faceted profile (FIG. 7). This will further tighten the beam spread, while maintaining the intended profile.

Typically the beam emitted by the beacon will be designed for rotational uniformity, i.e. equal intensity at a given vertical angle for all azimuthal angles. The use of a finite number of LEDs 8 around the reflector results in some rotational variation in beam intensity. Rotational variations may be more pronounced at certain vertical angles depending on the design of the reflector surface 10. Design can reduce rotational variations at critical angles such as peak intensity angle where some minimum intensity may be specified, while allowing greater rotational variation at angles where it does not violate any specification.

Figure 8:
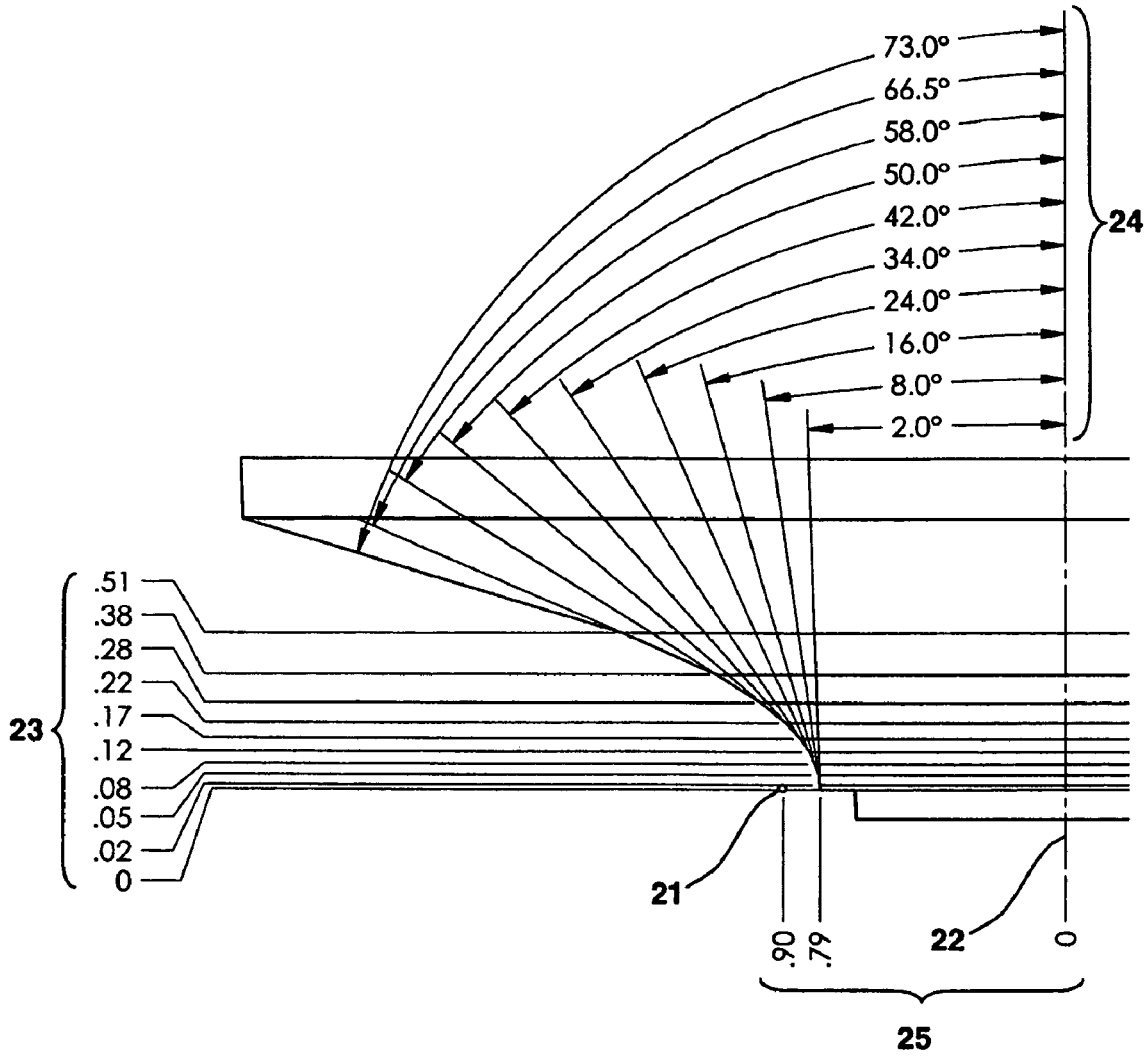
FIG. 8 is a partial side elevation of the reflector.
Figure 9:
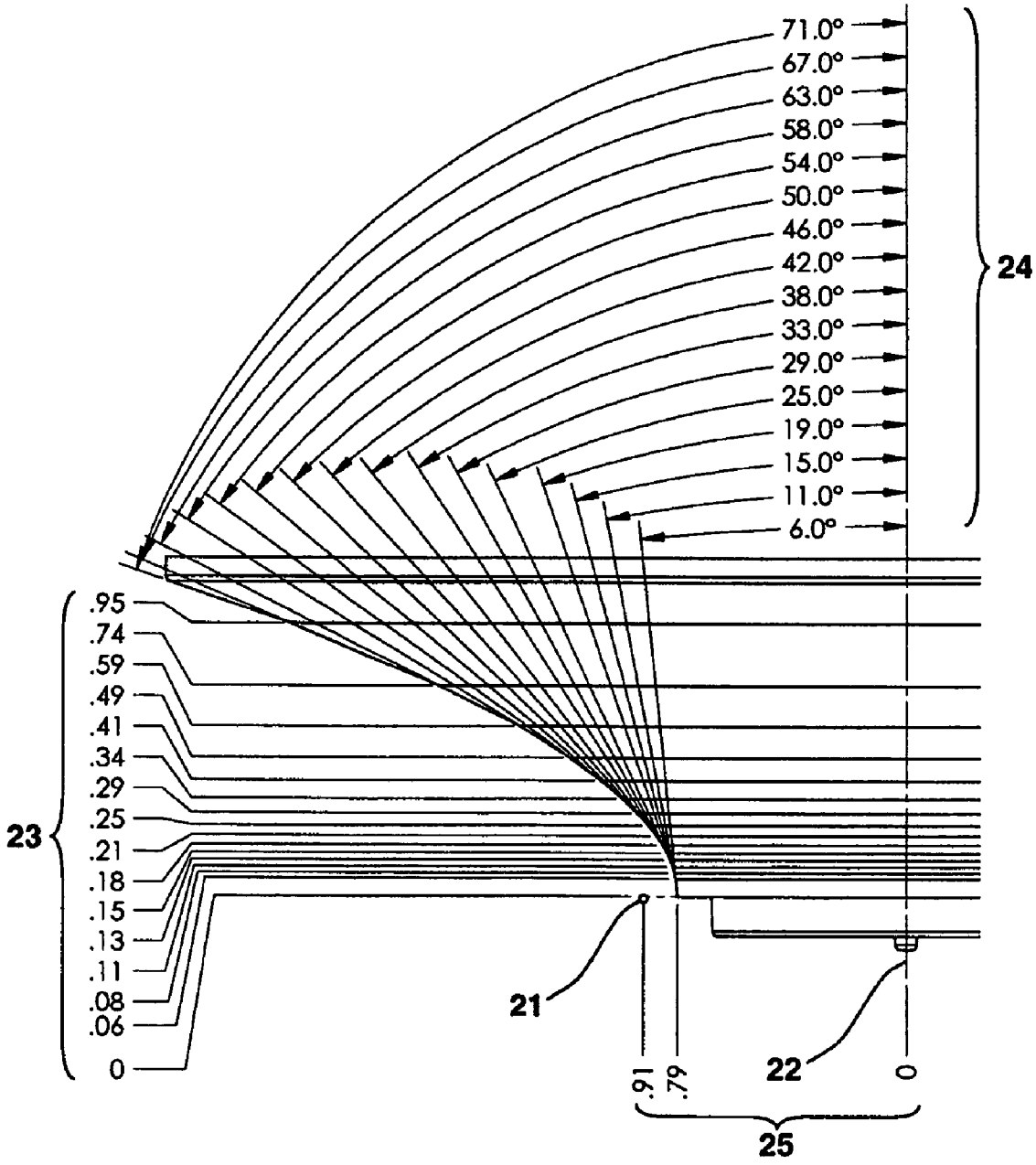
FIG. 9 is a partial side elevation of the reflector assembly of an embodiment corresponding to the intensity distribution illustrated in FIG. 6.

Increasing the number of LEDs 8 in the ring increases cost and complexity but can reduce rotational variation. 8 LEDs 8 gives reasonably low rotational variation when the proportions suggested by FIGS. 8 and 9 are used. Use of LEDs 8 with narrower beam width would increase rotational variation requiring more LEDs (8) in the ring. However this will also tend to reduce vertical beam spread and allow more efficient light collection.

The reflector surface 10 collects all light rays from the LEDs 8 directed inward and upward above some minimum upward angle. Rays directed outward from the ring and below this minimum upward angle 14 may escape unreflected. Ideally the reflector surface 10 will extend out far enough to collect all upward rays that are above the required vertical angular coverage for the light. However this may require excessive large diameter for the reflector as the reflector surface 10 diameter expands rapidly as the collection angle is increased. In one example rays above 30° can be collected and the reflector diameter is about 13 cm. For a Lambertian emitter the half power points typically lie at about 30° above the horizontal so that such a reflector surface 10 will collect most of the emitter light.

Light rays directed in towards the lower portion of the reflector surface 17 will be reflected back out by the reflector surface 10, as illustrated in FIG. 5, however some of them may impinge on the LEDs and be lost by absorption or scattered in useless directions. These losses are typically small for Lambertian emitters where most of the light is emitted above the horizontal plane so that the reflected rays mostly go over the top of the emitters.

Typically, at least one flat segment of the segmented reflector embodiment will have a diameter about the radial axis of the reflector that is greater than the diameter of the circular array of LEDs while at least one other flat segment will have a smaller diameter than that of the circular array.

FIGS. 8 and 9 describe two of the possible profiles of the reflector surface 10. The surface is described relative to the center axis 22 of the reflector surface 10 and to the radial location of the LEDs 8. The angles shown 24 describe the angle of the facets 15 relative to the vertical center axis 22. The vertical measurements 23 describe the vertical location of the lowest point of each facet relative to the focal point 21 of one of the LEDs 8. The horizontal measurements 25 describe the horizontal location of the focal point 21 of the LEDs 8 relative to the center axis 22 of the reflector 1 and the horizontal location of the lowest point of the lowest facet. The embodiment of FIG. 8 will create a narrow beam centered on the horizon. The embodiment of FIG. 9 will create beam centered above the horizon according to the specifications provided in FIG. 6.

Figure 10:
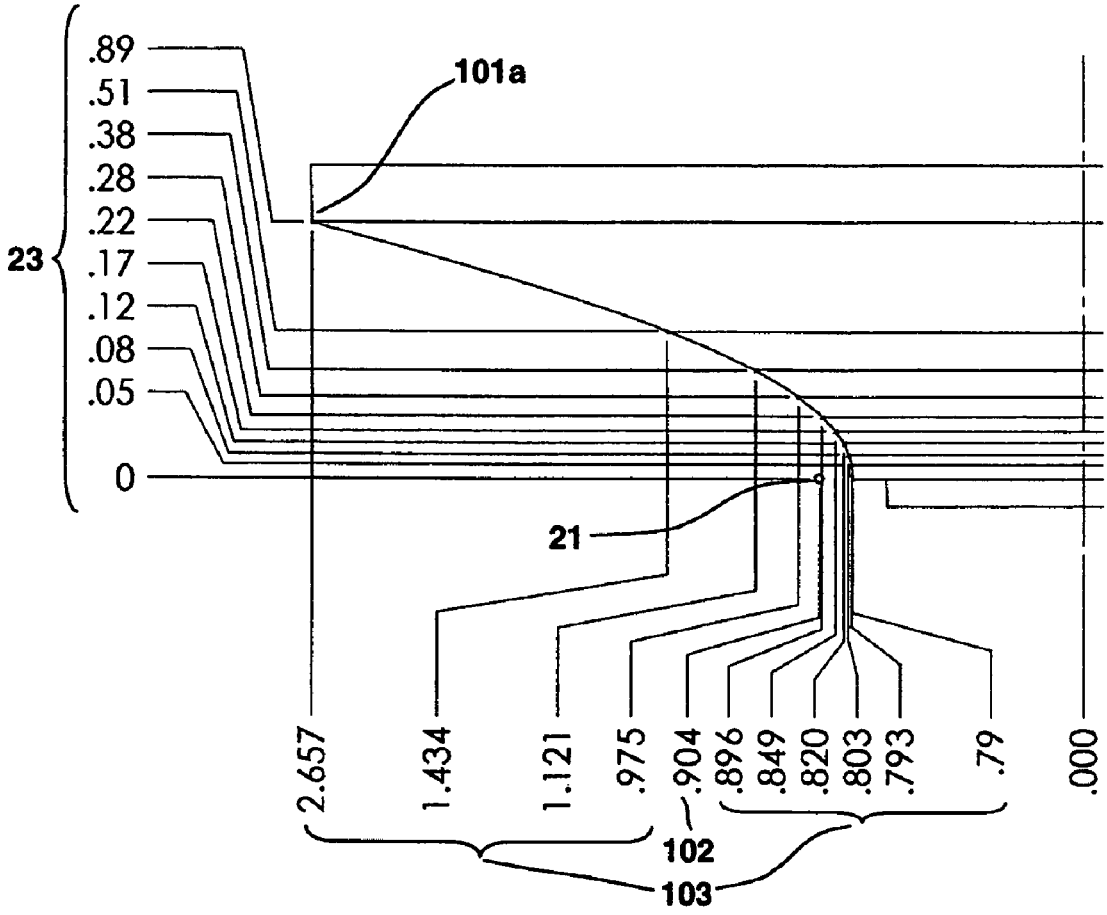
FIG. 10 is a partial side elevation of the reflector assembly of the embodiment of FIG. 8 with the lens surface segment parameters specified in X-Y coordinates.
Figure 11:
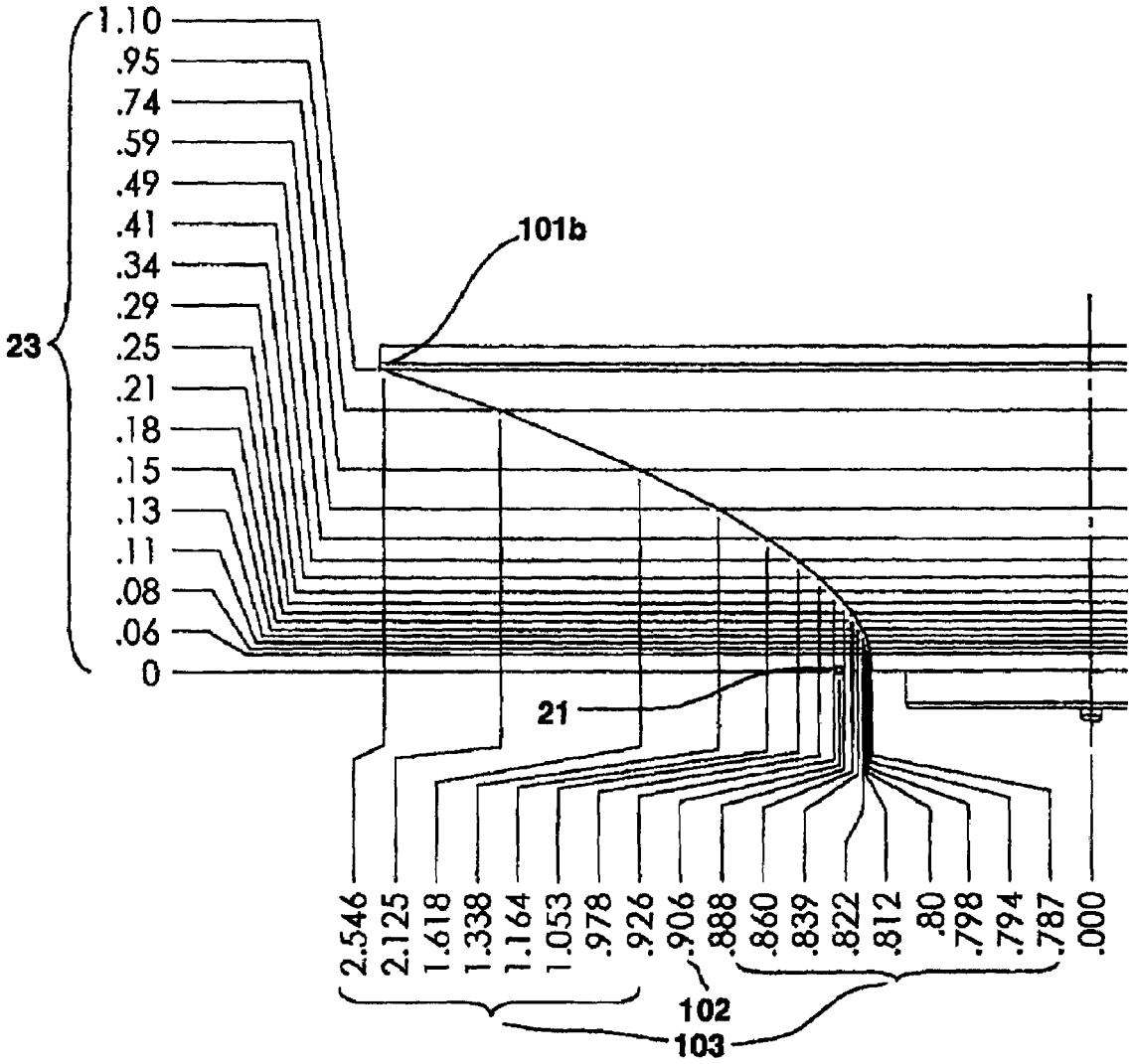
FIG. 11 is a partial side elevation of the reflector assembly of the embodiment of FIG. 9 with the lens surface segment parameters specified in X-Y coordinates.

FIGS. 10 and 11 depict the reflectors of FIGS. 8 and 9 respectively with the position 102 of the LED 8 indicated as a number of units along the X-axis. The measurement values in FIG. 10 and FIG. 11 are unit-less, as the designs will work provided that the specified proportions are followed. The position of the junction points of the individual facets indicated are also indicated in X-Y coordinates 103, 23. Some deviation from the ideal position of these junction points will still result in acceptable performance of the reflector 1. For example, a 20% relative deviation in the position of the points 101*a*, 101*b* may result in an acceptable performance for general purpose applications. A smaller deviation in the position of the points (such as 10%, 5%, 2%, etc.) may result in acceptable performance for more precise applications. In addition, variation in the position of the points may be more critical for some parts of the reflector 1 than others depending on the application.

It will be appreciated that alternate reflectors may be produced by changing the position of the facet junction points. The tables below shows the facet junction points for two possible alternate embodiments which are combinations of the embodiments shown in FIGS. 10 and 11.

| Y | X | Distance of facet from light source in X direction |
|---|---|---|
| Facet Junction Points (Alternate Embodiment 1) | | |
| 0.995 | 2.602 | 1.697 |
| 0.380 | 1.121 | 0.217 |
| 0.310 | 0.977 | 0.072 |
| 0.220 | 0.896 | −0.008 |
| 0.175 | 0.844 | −0.061 |
| 0.120 | 0.822 | −0.082 |
| 0.080 | 0.803 | −0.101 |
| 0.050 | 0.793 | −0.111 |
| Facet Junction Points (Alternate Embodiment 2) | | |
| 0.995 | 2.602 | 1.697 |
| 0.590 | 1.338 | 0.432 |
| 0.310 | 0.977 | 0.072 |
| 0.250 | 0.888 | −0.018 |
| 0.175 | 0.844 | −0.061 |
| 0.150 | 0.822 | −0.084 |
| 0.110 | 0.800 | −0.106 |
| 0.060 | 0.794 | −0.112 |

Figure 12:
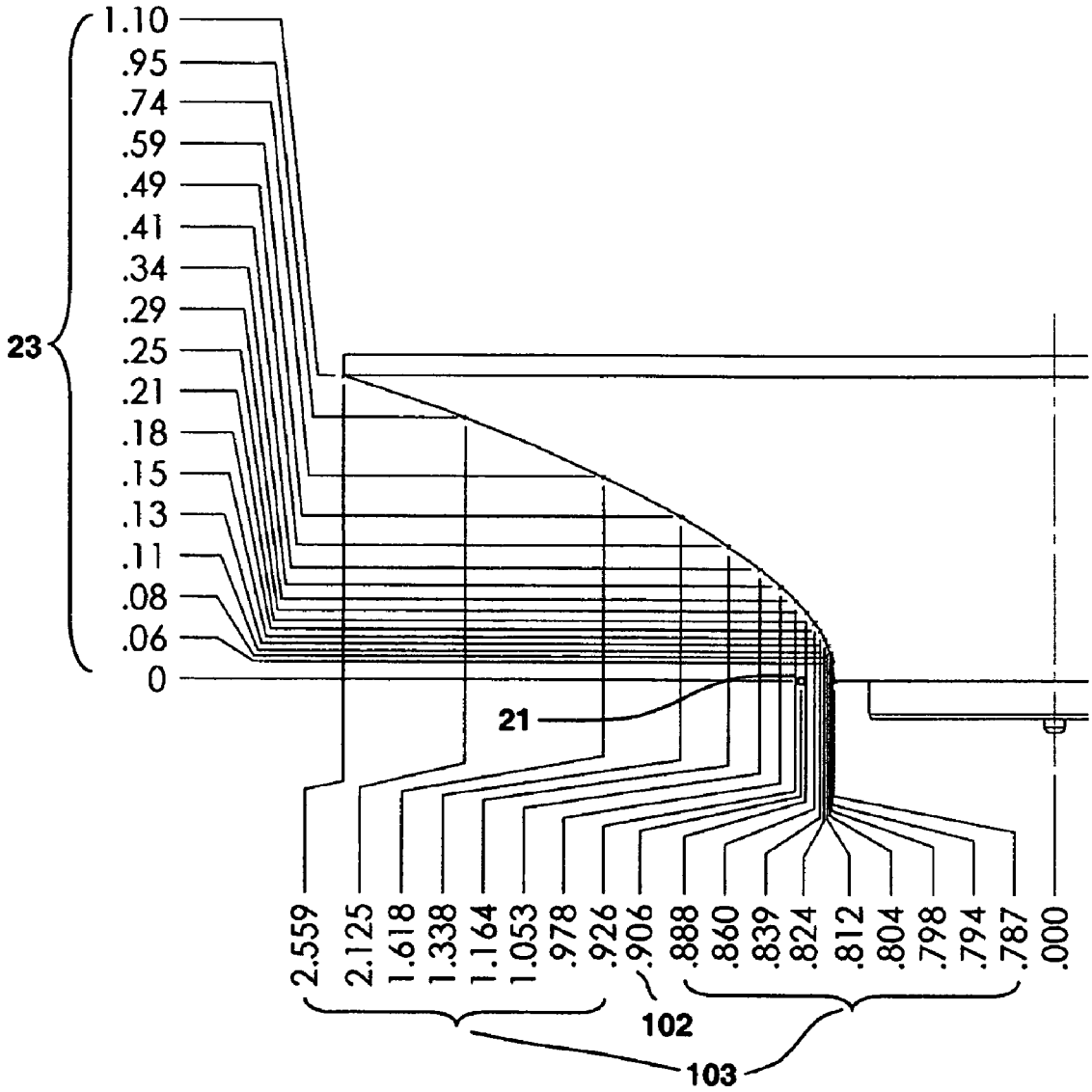
FIG. 12 is a partial side elevation of a reflector similar to that of FIG. 11, but with a smooth curved lens surface.

FIG. 12 depicts the reflector 1 in spline configuration and shows various points on the reflector 1 with X-Y coordinates 103, 23. This configuration may produce an acceptable flat beam of light for general purpose applications if the points on the reflector are within 20% of those shown. A smaller deviation in the position of the points in this implementation of the reflector 1 may result in acceptable performance in more precise applications.

The X-Y coordinates shown in FIGS. 10-12 are unitless. In other words, the reflector will function as expected as long as the relative positions of the points on the lens with respect to the light source are maintained. One embodiment for example may be realized with the dimensions shown in inches. Another embodiment may be realized with the dimensions shown in centimeters. Other usable embodiments may be realized with the dimensions shown being any unit of measure between half centimeters and two inches per unit.

It will be appreciated by those skilled in the art that the preferred and alternative embodiments have been described in some detail but that certain modifications may be practiced without departing from the principles of the invention.

We claim:

1. A solar-powered navigational light beacon, comprising:

a housing;

at least one solar panel mounted on said housing;

said housing including a mounting surface supporting a substantially planar circuit board thereon;

a reflector defining a smooth curve resolved about an axis, said revolved reflector having the aspect of an inverted cone truncated at its vertex and having a base axially opposed to said vertex;

said vertex of said revolved reflector being truncated by a substantially planar surface of said circuit board;

only one circular array of light emitting diodes having a Lambertian output pattern and being mounted on said circuit board, said circular array encircling said truncated vertex and having a diameter;

said base of said revolved reflective surface having a diameter that is larger than the diameter of said circular array;

said surface of said reflector comprising a first point located within 20% of 0.995 units of measure in a vertical direction and 20% of 1.697 units of measure in a horizontal direction from a location on said circular array;

said surface of said reflector further comprising a second point located within 20% of 0.31 units of measure in said vertical direction and 20% of 0.072 units of measure in said horizontal direction from said location; and said surface of said array comprising a third point located within 20% of 0.175 units of measure in said vertical direction and 20% of −0.061 units of measure in said horizontal direction from said location;

said first, second and third points lying in a common plane;

said beacon being configured to simultaneously emit a substantially horizontal fan of light about 360 degrees; and a circumferentially transparent cylindrical cover encasing said reflector.

2. The light beacon of claim 1 wherein said surface of said reflector passes through:

a fourth point located within 10% of 0.380 units of measure in said vertical direction and 10% of 0.217 units of measure in said horizontal direction from said location; and a fifth point located within 10% of 0.08 units of measure in said vertical direction and 10% of −0.101 units of measure in said horizontal direction from said location; and, wherein said fourth and fifth points lie in said common plane.

3. The light beacon of claim 2 wherein said surface of said reflector passes through:

a sixth point located within 5% of 0.05 units of measure in said vertical direction and 5% of −0.111 units of measure in said horizontal direction from said location;

a seventh point located within 5% of 0.12 units of measure in said vertical direction and 5% of −0.084 units of measure in said horizontal direction from said location; and an eighth point located within 5% of 0.22 units of measure in said vertical direction and 5% of −0.008 units of measure in said horizontal direction from said location; and, wherein said sixth, seventh and eighth points lie in said common plane.

4. The light beacon of claim 1 wherein said surface of said reflector passes through:

a fourth point located within 10% of 0.590 units of measure in said vertical direction and 10% of 0.432 units of measure in said horizontal direction from said location; and a fifth point located within 10% of 0.11 units of measure in said vertical direction and 10% of −0.106 units of measure in said horizontal direction from said location; and, wherein said fourth and fifth points lie in said common plane.

5. The light beacon of claim 2 wherein said surface of said reflector passes through:

a sixth point located within 5% of 0.25 units of measure in said vertical direction and 5% of −0.018 units of measure in said horizontal direction from said location;

a seventh point located within 5% of 0.15 units of measure in said vertical direction and 5% of −0.084 units of measure in said horizontal direction from said location; and an eighth point located within 5% of 0.06 units of measure in said vertical direction and 5% of −0.112 units of measure in said horizontal direction from said location; and, wherein said sixth, seventh and eighth points lie is said common plane.

* * * * *

UNITED STATES PATENT AND TRADEMARK OFFICE

CERTIFICATE OF CORRECTION

PATENT NO. : 7,572,030 B2
APPLICATION NO. : 11/471977
DATED : August 11, 2009
INVENTOR(S) : Ian Booth and Brock Johnston It is certified that error appears in the above-identified patent and that said Letters Patent is hereby corrected as shown below:

Column 6, claim 1, line 6, "resolved" should be -- revolved --.

Column 8, claim 5, line 14, "is" should be -- in --.

Signed and Sealed this

Tenth Day of November, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,572,030 B2
APPLICATION NO. : 11/471977
DATED : August 11, 2009
INVENTOR(S) : Booth et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 299 days.

Signed and Sealed this

Fourteenth Day of December, 2010

David J. Kappos

David J. Kappos
*Director of the United States Patent and Trademark Office*